US005826660A

United States Patent [19]

Rytlewski

[11] Patent Number: 5,826,660

[45] Date of Patent: Oct. 27, 1998

[54] DUAL ACTION VALVE INCLUDING A BUILT IN HYDRAULIC CIRCUIT

[75] Inventor: Gary L. Rytlewski, League City, Tex.

[73] Assignee: Schlumberger Technology Corporation, Sugar Land, Tex.

[21] Appl. No.: 665,614

[22] Filed: Jun. 18, 1996

[51] Int. Cl.[6] ..... E21B 34/10

[52] U.S. Cl. ..... 166/373; 166/319

[58] Field of Search ..... 166/319, 321, 166/324, 72, 373, 374

[56] References Cited

U.S. PATENT DOCUMENTS

| | | | |
|---|---|---|---|
| 2,951,536 | 9/1960 | Garrett . | |
| 3,554,281 | 1/1971 | Ecuer | 166/155 |
| 4,109,725 | 8/1978 | Williamson et al. . | |
| 4,234,043 | 11/1980 | Roberts | 166/336 |
| 4,324,293 | 4/1982 | Hushbeck . | |
| 4,325,409 | 4/1982 | Roberts | 166/72 X |
| 4,325,434 | 4/1982 | Roberts | 166/321 |
| 4,403,659 | 9/1983 | Upchurch . | |
| 4,617,999 | 10/1986 | Beck | 166/372 |
| 4,736,798 | 4/1988 | Zunkel . | |
| 4,817,723 | 4/1989 | Ringgenberg . | |
| 4,907,655 | 3/1990 | Hromas et al. . | |
| 4,979,569 | 12/1990 | Anyan et al. . | |

FOREIGN PATENT DOCUMENTS

| | | |
|---|---|---|
| 0063519 A2 | 10/1982 | European Pat. Off. . |
| 2006854 | 5/1979 | United Kingdom . |
| 2074634 | 11/1981 | United Kingdom . |

*Primary Examiner*—Frank Tsay

*Attorney, Agent, or Firm*—Gordon G. Waggett; John H. Bouchard; John J. Ryberg

[57] ABSTRACT

A valve for use downhole in a wellbore can be repeatedly opened and closed any number of times in response to a pressure signal transmitted down the annulus of the wellbore. The valve is set and changes from a first position to a second position in response to a first pressure signal transmitted down the annulus, a pressure value of the first pressure signal transmitted down the annulus being greater than a pressure value of a pressure existing in an inside annular space of the valve by an amount at least equal to a predetermined value. The valve resets itself and changes back from the second position to the first position in response to a second pressure signal transmitted down the annulus, the pressure value of the pressure existing in the inside annular space of the valve being greater than a pressure value of the second pressure signal transmitted down the annulus by an amount at least equal to the predetermined value.

22 Claims, 2 Drawing Sheets

DUAL ACTION VALVE INCLUDING A BUILT IN HYDRAULIC CIRCUIT

BACKGROUND OF THE INVENTION

The subject matter of the present invention relates to a valve apparatus adapted for use in a wellbore during a well testing operation, and more particularly, to the valve apparatus adapted for use in the wellbore for changing from a first closure position to a second closure position when a pressure difference, representing a difference between the pressure outside the valve apparatus and the pressure in an inside annular space of the valve apparatus, is greater than or equal to a predetermined value, and for changing from the second closure position to the first closure position when a pressure difference, representing a difference between the pressure in the inside annular space of the valve apparatus and the pressure outside the valve apparatus, is greater than or equal to a predetermined value.

Valves are used downhole in a wellbore during well testing operations. For example, during a well testing operation, a test valve changes from a closed position to an open position thereby allowing a wellbore fluid, flowing from a perforated formation, to enter a production tubing and flow uphole. In order to change the test valve from the closed position to the open position, several steps must be performed. For example, a pressure signal is transmitted down an annulus of the wellbore. The test valve may include a rupture disc. If the pressure signal is high enough, the rupture disc would rupture, and a piston in the test valve would move. Movement of the piston would cause a port in the mandrel to move into alignment with a port in an outer housing of the valve thereby changing the test valve from a closed position to an open position. Alternatively, the test valve may be a "dual action valve" of the type disclosed in U.S. Pat. No. 4,979,569 to Anyan et al, entitled "Dual Action Valve Including at least Two Pressure Responsive Members". In the Anyan et al patent, a first pressure would rupture a first rupture disc when the first pressure is greater than or equal to a first predetermined threshold pressure value and move a piston for changing the closure position of the valve from a first closure position to a second closure position; and a second pressure would rupture a second rupture disc when the second pressure is greater than or equal to a second predetermined threshold pressure value which is greater than the first predetermined threshold pressure value and move the piston for changing the closure position of the valve from the second closure position to the first closure position.

However, when a valve including a single rupture disc is operated, the rupture disc is ruptured and a piston is moved from a first position to a second position. Once the rupture disc is ruptured, it cannot be used again. In the case of a dual action valve involving two rupture discs, when the first rupture disc is ruptured and the valve is changed to a second closure condition, and when the second rupture disc is ruptured and the valve is changed back to a first closure condition, both rupture discs are permanently ruptured and, as a result, the dual action valve cannot be used again during another operation. In that case, the dual action valve must be replaced by another such valve.

It would be desirable to design a special multi-purpose valve for use downhole in a wellbore that can be repeatedly opened and closed any number of times as desired by an operator in response to an annulus pressure transmitted down the wellbore.

SUMMARY OF THE INVENTION

Accordingly, it is a primary object of the present invention to provide a valve for use downhole in a wellbore that can be repeatedly opened and closed any number of times in response to a pressure signal transmitted down the annulus of the wellbore.

It is a further object of the present invention to provide a valve for use downhole in a wellbore that can be repeatedly opened and closed any number of times in response to a pressure signal transmitted down the annulus of the wellbore, the valve being set and changing from a first position to a second position in response to a first pressure signal transmitted down the annulus, where a pressure value of the first pressure signal transmitted down the annulus is greater than an a pressure value of a pressure existing in an inside annular space of the valve by an amount at least equal to a predetermined value, the valve resetting itself and changing back from the second position to the first position in response to a second pressure signal transmitted down the annulus, where the pressure value of the pressure existing in the inside annular space of the valve is greater than a pressure value of the second pressure signal transmitted down the annulus by an amount at least equal to the predetermined value.

It is a further object of the present invention to provide a valve for use downhole in a wellbore that can be repeatedly opened and closed any number of times in response to a pressure signal transmitted down the annulus of the wellbore, the valve being set and changing from a first position to a second position in response to a first pressure signal transmitted down the annulus, where a pressure value of the first pressure signal transmitted down the annulus is greater than an a pressure value of a pressure existing in an inside annular space of the valve by an amount at least equal to a predetermined value, the valve resetting itself and changing back from the second position to the first position in response to a second pressure signal transmitted down the annulus, where the pressure value of the pressure existing in the inside annular space of the valve is greater than a pressure value of the second pressure signal transmitted down the annulus by an amount at least equal to the predetermined value, the valve including a built-in hydraulic circuit where a nitrogen gas is exerted against a bottom side of a piston and, when a shoulder of a collet moves out of a second notch in an outer housing into a first notch, moving the piston in a first direction and changing the valve from the first position to the second position in response to the first pressure signal transmitted down the annulus, where a pressure value of the first pressure signal is greater than a pressure value of the pressure existing in the inside annular space of the valve by an amount equal to the predetermined value, the nitrogen gas that is being exerted against the bottom side of the piston being ported off to a chamber which is located above a top side of the piston after the valve has changed to the second position, the nitrogen gas in the chamber above the piston being exerted against a top side of the piston, and, when the shoulder of the collet moves out of the first notch into the second notch in an outer housing, moving the piston in a second direction which is opposite to the first direction and changing the valve back from the second position to the first position thereby resetting the valve in response to a second pressure signal transmitted down the annulus, where a pressure value of the pressure existing in the inside annular space of the valve is greater than a pressure value of the second pressure signal by an amount equal to the predetermined value.

In accordance with these and other objects of the present invention, a valve for use downhole in a wellbore can be repeatedly opened and closed any number of times in response to a pressure signal transmitted down the annulus of the wellbore. The valve is set and changes from a first position to a second position in response to a first pressure signal transmitted down the annulus, a pressure value of the first pressure signal transmitted down the annulus being greater than a pressure value of a pressure existing in an inside annular space of the valve by an amount at least equal to a predetermined value. The valve resets itself and changes back from the second position to the first position in response to a second pressure signal transmitted down the annulus, the pressure value of the pressure existing in the inside annular space of the valve being greater than a pressure value of the second pressure signal transmitted down the annulus by an amount at least equal to the predetermined value.

The valve includes a built-in hydraulic circuit and a piston, a nitrogen gas being exerted against a bottom side of the piston. When a shoulder of a collet moves out of a second notch in an outer housing into a first notch, the piston moves in a first direction, changing the valve from the first position to the second position in response to the first pressure signal transmitted down the annulus. However, a pressure value of the first pressure signal is greater than a pressure value of the pressure existing in the inside annular space of the valve by an amount equal to the predetermined value. The nitrogen gas that is being exerted against the bottom side of the piston is ported off to a chamber which is located above a top side of the piston after the valve has changed to the second position. The nitrogen gas in the chamber above the piston is exerted against a top side of the piston. When the shoulder of the collet moves out of the first notch and into the second notch in an outer housing, the piston moves in a second direction which is opposite to the first direction and changes the valve back from the second position to the first position thereby resetting the valve in response to a second pressure signal transmitted down the annulus. However, a pressure value of the pressure existing in the inside annular space of the valve is greater than a pressure value of the second pressure signal by an amount equal to the predetermined value.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DETAILED DESCRIPTION OF THE PREFERRED EMBODIMENT

Figure 1:
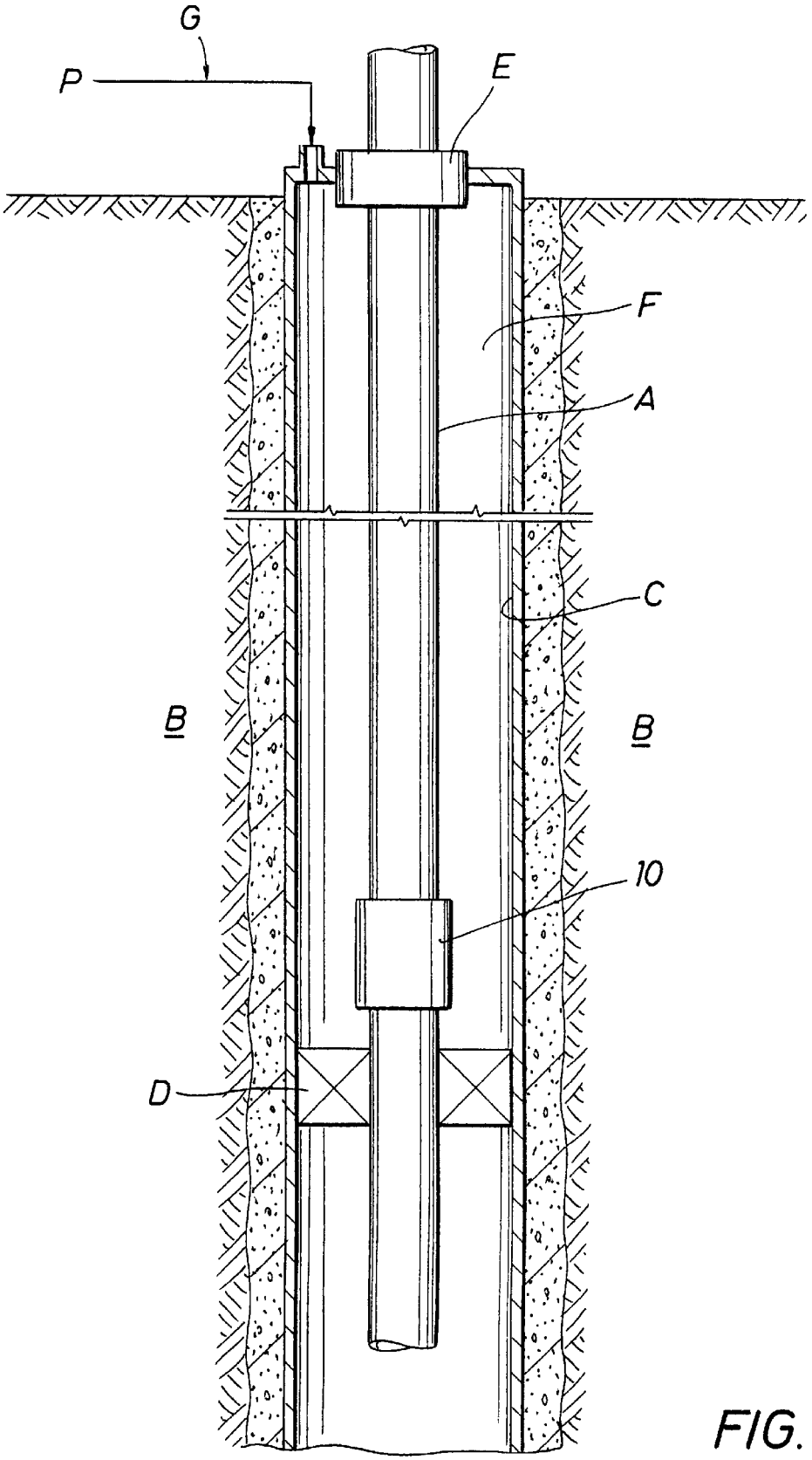
FIG. 1 illustrates a wellbore including a tubing string disposed within a casing thereby defining an annulus between the tubing string and the casing, a packer which seals the tubing to the casing, and a valve of the present invention disposed within the tubing and situated above the packer in the wellbore.

Referring to FIG. 1, a tubing string A is disposed in a wellbore B which is lined by a casing C thereby defining an annulus F between the tubing A and the casing C. A packer D seals the tubing string A against the casing C. The tubing string A hangs in the wellbore B via a tubing hanger E, and a pressure "P" is pumped into the annulus F via a pump line G. A valve 10, in accordance with the present invention, is disposed within the tubing A and the valve 10 is situated above the packer D in the wellbore B.

Figure 2:
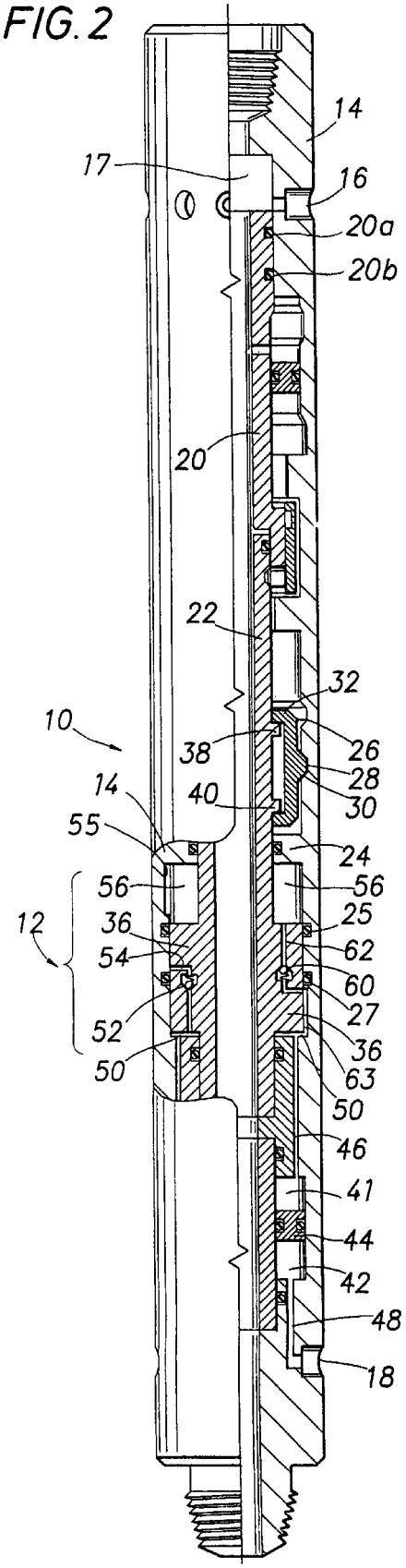
FIG. 2 illustrates a more detailed construction of the valve of FIG. 1 of the present invention disposed in a first position (either open or closed)
Figure 3:
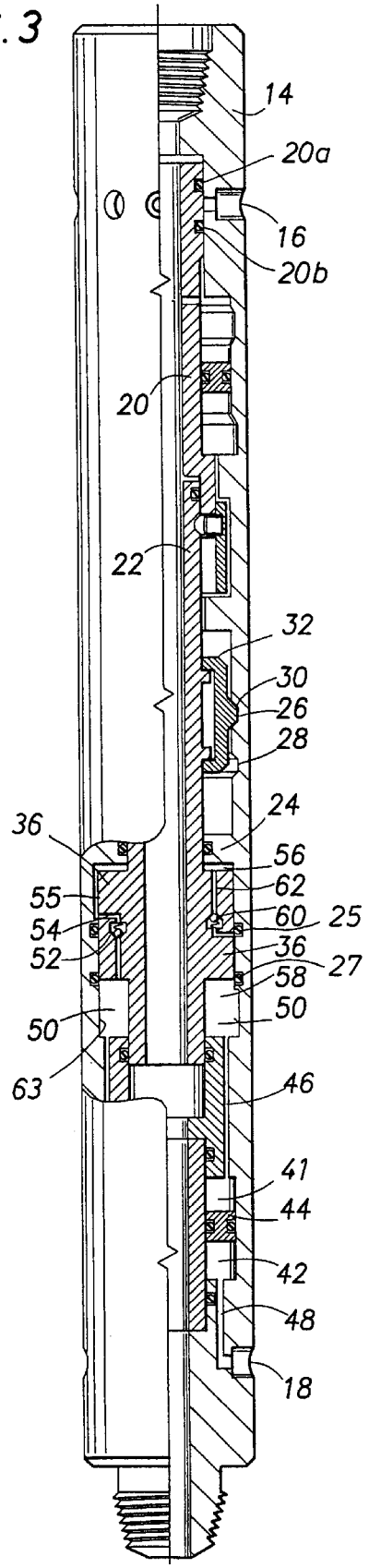
FIG. 3 illustrates the valve of the present invention of FIGS. 1 and 2 disposed in a second position.

Referring to FIGS. 2 and 3, a more detailed construction of the valve 10 of the present invention is illustrated.

In FIG. 2, the valve 10 in accordance with the present invention is shown disposed in the first position, which, in FIG. 2, is the closed position. In FIG. 2, the valve 10 for use downhole in a wellbore can be repeatedly opened and closed any number of times in response to a pressure signal transmitted down the annulus of the wellbore.

In fact, the valve 10 can be set, changing from a first position to a second position, in response to a first pressure signal transmitted down the annulus, a pressure value of the first pressure signal transmitted down the annulus being greater than a pressure value of a pressure existing in an inside annular space of the valve by an amount at least equal to a predetermined value.

The valve 10 resets itself and changes back from the second position to the first position in response to a second pressure signal transmitted down the annulus, the pressure value of the pressure existing in the inside annular space of the valve being greater than a pressure value of the second pressure signal transmitted down the annulus by an amount at least equal to the predetermined value. Alternatively stated, the pressure value of the second pressure signal transmitted down the annulus is less than the pressure value of the pressure existing in the inside annular space of the valve by an amount equal to the predetermined value.

In FIG. 2, the valve 10 of the present invention includes a novel hydraulic circuit 12 which will allow the valve 10 to set, causing the valve 10 to change from a first position to a second position, in response to a first pressure signal transmitted down the annulus which has a pressure value that is greater than the pressure value of the pressure existing in the inside annular space 56 of the valve 10 by an amount equal to a predetermined value. On the other hand, the hydraulic circuit 12 of the valve 10 will allow the valve 10 to reset, causing the valve 10 to change back from the second position to the first position, in response to a second pressure signal transmitted down the annulus which has a pressure value which is less than the pressure value of the pressure existing in the inside annular space 56 of the valve by an amount equal to the predetermined value.

In FIG. 2, the valve 10 adapted to be disposed in a wellbore includes the hydraulic circuit 12 which will be developed in more detail later in this specification. The valve 10 further includes an outer housing 14.

The outer housing 14 includes a first port 16 disposed through the housing 14, the first port 16 being adapted to open into a full bore 17 of the valve 10, achieving the open position, when a first longitudinally movable mandrel 20 in the valve 10 is moved to a lowermost position as shown in FIG. 2. However, the first port 16 does not open into the full bore 17 of the valve 10, achieving a closed position, when the first mandrel 20 is moved to an uppermost position as shown in FIG. 3.

The first mandrel 20 includes a pair of o-rings 20*a*, 20*b* which are adapted to flank the first port 16 (the word "flank" meaning that one o-ring 20*a* is disposed on one side of the first port 16, and the other o-ring 20*b* is disposed on the other side of the first port 16) in the outer housing 14, shown in FIG. 3, when the first mandrel 20 is moved to the uppermost position. When the o-rings 20*a*, 20*b* flank the first port 16 as shown in FIG. 3, the first port 16 is closed, not opening into the full bore 17 of the valve 10. However, when the o-rings 20*a*, 20*b* do not flank the first port 16, shown in FIG. 2, the first port 16 is open since it opens into the full bore 17 of the valve 10.

The outer housing 14 further includes a first notch 26 and a second notch 28 cut into an interior wall of the outer housing 14 adapted to receive a shoulder 30 of a collet 32 (the collet 32 will be developed later in this specification). A first piston 24 is integrally connected to the outer housing 14 and is transversely disposed within an interior of the outer housing 14. A pair of o-rings 25 and 27 are disposed within an interior wall of the outer housing 14. A second port 18 is adapted to receive an annulus fluid disposed within an annulus F of the wellbore, and a passage 48 interconnects the second port 18 with an annulus fluid chamber 42. The outer housing 14 of the valve 10 encloses the first mandrel 20. The first mandrel 20 is movable in a longitudinal direction. The outer housing 14 also encloses a second mandrel 22 and a collet 32, the collet 32 being located between the second mandrel 22 and the outer housing 14. The collet 32 includes two end pieces and a centrally disposed shoulder 30 which points outwardly and is adapted to move into the first notch 26 or the second notch 28 in the outer housing. The second mandrel 22 includes a top shoulder 38 and a bottom shoulder 40 each of which point outwardly, and a second piston 36, the top shoulder 38 being adapted to be received into the interior of the collet 32 and into contact with one end piece of the collet 32, the bottom shoulder 40 being adapted to be received into the interior of the collet 32 and into contact with the other end piece of the collet 32. As noted earlier, the outer housing 14 includes the second port 18 disposed at a bottom of the valve 10 which fluidly communicates with a passage 48, the passage 48 fluidly communicating with an annulus fluid chamber 42. An intermediate piston 44 separates the annulus fluid chamber 42 from a nitrogen chamber 41 which is initially filled with a nitrogen gas. A passage 46 provides a communication channel between the nitrogen chamber 41 and an annular space 50, the annular space 50 being located at a bottom of the hydraulic circuit 12.

In FIG. 2, the hydraulic circuit 12 further includes a passage 54 leading from the annular space 50 to an exterior wall of the second piston 36. A space 55 adapted to be disposed between the exterior wall of the second piston 36 and the outer housing 14 defines another passage 55 which leads from the passage 54 to a top chamber 56. The top chamber 56 is identified above as an "inside annular space" and may hereinafter also be called the "inside annular space 56". The other passage 55 fluidly communicates with the top chamber or inside annular space 56. Therefore, the passage 54 will fluidly communicate with the top chamber 56 via the other passage 55. A first check valve 52 is located within the passage 54. The first check valve 52 will allow a fluid to flow from the annular space 50, through the passage 54, and upwardly through the other passage 55 when the second piston 36 is disposed in the position shown in FIG. 3, but the first check valve 52 will not allow the fluid to flow downwardly from the other passage 55 and through the passage 54 to the annular space 50. A pair of o-rings 25, 27 are disposed in an interior wall of the outer housing 14, the o-rings 25, 27 flanking an upper part of the passage 54 in FIG. 2 where the passage 54 exits into the exterior wall of the second piston 36. In FIG. 2, if any fluid attempts to exit upwardly from the passage 54 at the exterior wall of the second piston 36, that fluid will not be allowed to flow further because the o-rings 25, 27 will prevent any upwardly directed fluid flow.

However, in FIG. 3, another passage 62 disposed in the second piston 36 leads downwardly from a top chamber 56 to an exterior wall of the second piston 36, and still another passage 63 is defined between the exterior wall of the second piston 36 and the outer housing 14 when the second piston 36 is disposed in its position shown in FIG. 2, the still another passage 63 providing a further fluid flow path between the top chamber 56 and the passage 62 on one side and a bottom chamber 58 on the other side, the bottom chamber 58 being part of the aforementioned annular space 50. The bottom chamber 58 fluidly communicates with the nitrogen chamber 41 via the passage 46. A second check valve 60 is disposed in the passage 62. The second check valve 60 will allow fluid to flow within the passage 62 from the top chamber (inside annular space) 56 downwardly through passage 63 and into the passage 46 as shown in FIG. 2, but the second check valve 60 will not allow any fluid to flow upwardly from passage 63, through passage 62, to the inside annular space or top chamber 56. In FIG. 3, the o-rings 25, 27 are shown to be flanking the passage 62 at the exterior wall of the second piston 36. Therefore, in FIG. 3, the o-rings 25,27 will prevent any fluid from flowing from passage 62 into the other passage 63.

A functional description of the operation of the dual action valve 10 including the hydraulic circuit 12 of the present invention will be set forth in the following paragraphs with reference to FIGS. 1, 2, and 3 of the drawings.

Recall that the valve 10 of the present invention includes a novel hydraulic circuit 12 which will allow the valve 10 to set, causing the valve 10 to change from a first position to a second position, in response to a first pressure signal transmitted down the annulus F which has a pressure value that is greater than the pressure value of the pressure existing in the inside annular space (or top chamber) 56 of the valve by an amount equal to a predetermined value, the hydraulic circuit 12 allowing the valve 10 to reset, causing the valve 10 to change back from the second position to the first position, in response to a second pressure signal transmitted down the annulus F which has a pressure value which is less than the pressure value of the pressure existing in the inside annular space 56 of the valve 10 by an amount equal to the predetermined value. In the preferred embodiment of the present invention, the above referenced "predetermined value" is approximately equal to 600 psi.

Assume that the valve 10 of FIGS. 2 and 3 is disposed in the wellbore B of FIG. 1, and that a wellbore fluid is disposed in an annulus F of the wellbore. Assume further that the valve 10 is initially disposed in the first position, and that FIG. 2 illustrates the valve 10 disposed in the first position. When the valve 10 is disposed in the first (open) position as shown in FIG. 2, both of the o-rings 20*a*, 20*b* in the mandrel 20 are disposed below the port 16. As a result, the wellbore fluid in the annulus F can enter the port 16, flow into the full bore 17 of the valve 10, and flow uphole. In response to the first pressure signal "P" of FIG. 1 transmitted down the annulus F from pump line G, the wellbore fluid in the annulus F will enter the second port 18 of FIG. 2 and travel through passage 48 to the annulus fluid chamber 42 where it will apply a fluid pressure to the bottom side of the intermediate piston 44. Recalling that a nitrogen gas is disposed in the nitrogen chamber 41, the intermediate piston 44 will apply a pressure to the nitrogen gas in the nitrogen chamber 41 in response to the fluid pressure being applied to the bottom side of piston 44 by the wellbore fluid in the annulus fluid chamber 42. In response to the pressure being exerted on the nitrogen gas in the nitrogen chamber 41, the nitrogen gas will travel through the passage 46 and will enter the annular space 50 in FIG. 2. The upwardly applied pressure of the nitrogen gas in the annular space 50 will be exerted against an underside of the second piston 36 which will tend to cause the second piston 36 to move upwardly in FIG. 2. However, since the top shoulder 38 on the second mandrel 22 abuts against the top portion of the collet 32 and the shoulder 30 of collet 32 is disposed in the second notch 28 in the outer housing 14, any upward movement of the second piston 36 is resisted by the abutment of the top shoulder 38 against the top portion of the collet 32 and by the abutment of the second notch 28 on shoulder 30 of the collet 32.

Eventually, if the upwardly applied force being applied to the second piston 36 by the nitrogen in the annular space 50 is high enough, the shoulder 30 of the collet 32 will move out of the second notch 28 in the outer housing 14 and then the shoulder 30 will move into the first notch 26 in the outer housing 14. That is, if the pressure value of the pressure of the wellbore fluid in the annulus F of FIG. 1, or the pressure value of the pressure existing inside the annular space 50, is greater than the pressure value of the pressure existing in the inside annular space (top chamber) 56 by an amount equal to a "predetermined value" (which, in the preferred embodiment, is 600 psi), then the shoulder 30 of the collet 32 will move out of the second notch 28 in the outer housing 14, and the shoulder 30 will move into the first notch 26 in the outer housing 14. Note that the shape and configuration of the second notch 28 establishes the amount of the "predetermined value" which in the preferred embodiment is 600 psi.

When the shoulder 30 moves into the first notch 26, the o-rings 20*a*, 20*b* will flank the first port 16 in the outer housing 14 (one o-ring 20*a* will be disposed on one side of the port 16, and the other o-ring 20*b* will be disposed on the other side of the port 16), as shown in FIG. 3. When this happens, the valve 10 of FIG. 1 has changed from the first (open) position to the second (closed) position.

In the meantime, during the upward movement of the second piston 36, and the second mandrel 22, and the first mandrel 20 in FIG. 2, the passage 54 in FIG. 1, which is currently disposed between the o-rings 25, 27 in FIG. 2, will move upwardly past the o-ring 25, and the passage 54 will eventually be disposed above the o-ring 25 as shown in FIG. 3. Recalling that the first check valve 52 is a one-way check valve, allowing fluid or nitrogen gas movement to flow from bottom to top in FIG. 2, the nitrogen gas in the annular space 50 will travel upwardly through the passage 54, through the first check valve 52, and through the remaining part of the passage 54. When the second piston 36 moves upwardly enough such that the passage 54 is disposed above the top o-ring 25, as shown in FIG. 3, the nitrogen gas in the remaining part of the passage 54 will travel through the passage 55 in FIG. 3 and will enter the inside annular space (top chamber) 56 in FIG. 3. The nitrogen gas enters the inside annular space (top chamber 56) of FIG. 3 in response to the pressure applied to the nitrogen gas in the nitrogen chamber 41 by the intermediate piston 44 (the piston 44 is moving upwardly in response to the wellbore fluid in the annulus F entering the second port 18).

In FIG. 3, the pressure of the nitrogen gas in the inside annular space (top chamber) 56 tends to push the second piston 36 downwardly in FIG. 3. In addition, the nitrogen in the top chamber 56 enters the passage 62 in FIG. 3 and flows through the one-way second check valve 60. However, since the end of the passage 62 in FIG. 3 is disposed between the two o-rings 25, 27, the passage 62 is blocked. In response to the pressure of the nitrogen gas in the top chamber 56, the second piston 36 tends to move downwardly in FIG. 3. However, the downward movement of the second piston 36 is resisted by the first notch 26, which applies a resistance to the shoulder 30 of collet 32.

Eventually, if the pressure of the nitrogen gas in the inside annular space (top chamber) 56 is high enough, the second piston 36 and second mandrel 22 and first mandrel 20 will move downwardly, as shown in FIG. 2. That is, if the pressure of the wellbore fluid in the annulus F of FIG. 1, or the pressure in the annular space 50, is less than the pressure existing in the inside annular space (top chamber) 56 by an amount equal to the "predetermined value", which, in the preferred embodiment, is 600 psi, the second piston 36 and second mandrel 22 and first mandrel 20 will move downwardly, as shown in FIG. 2, and the shoulder 30 of collet 32 will move out of the first notch 26 in the outer housing and into the second notch 28 of the outer housing 14. Alternatively stated, if the pressure existing in the inside annular space (top chamber) 56 is greater than the pressure of the wellbore fluid in the annulus F. or the pressure existing in the annular space 50 in FIG. 3, by an amount equal to the "predetermined value", which is typically 600 psi, the second piston 36 and second mandrel 22 and first mandrel 20 move downwardly in FIG. 2, and the shoulder 30 of collet 32 moves out of the first notch 26 and into the second notch 28 of the outer housing 14. Note that the shape and configuration of the first notch 26 establishes the "predetermined value" (600 psi in the preferred embodiment).

When the second piston 36 moves downwardly in response to the pressure applied to the second piston 36 by the nitrogen gas in the inside annular space (top chamber) 56, and when the end of the passage 62 moves below the o-ring 27 in FIG. 2, the passage 62 is no longer blocked by the o-rings 25, 27. As a result, the nitrogen gas in the passage 62 travels through the second check valve 60, into the passage 63 in FIG. 2, into the passage 46, and into the nitrogen chamber 41. Since the second piston 36 moved downwardly in FIG. 2 by a distance which allowed the passage 62 to move below the o-ring 27, the o-rings 20*a*, 20*b* in FIG. 2 move below the first port 16 in the outer housing 14. As a result, when this happens, the valve 10 of FIG. 1 has changed from the second (closed) position of FIG. 3 to the first (open) position of FIG. 2.

The above description reveals that the valve 10 of the present invention, shown in FIGS. 2 and 3, utilizes no rupture discs. However, as a result of the use by valve 10 of the hydraulic circuit 12, the valve 10 will change from a first position to a second position when the pressure of the wellbore fluid in the annulus F, entering the second port 18, and locating in the annular space 50, is greater than the pressure existing in the inside annular space (top chamber) 56 by an amount equal to a "predetermined value", typically about 600 psi. However, the valve 10 will change back from the second position to the first position when the pressure of the wellbore fluid in the annulus F and in the annular space 50 is less than the pressure in the inside annular space 56 by an amount equal to the "predetermined value".

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. An apparatus having a full bore adapted to be disposed in a wellbore, an annulus area being defined between said apparatus and said wellbore when said apparatus is disposed in said wellbore, comprising:

an outer housing including a first port adapted to provide fluid communication between said annulus area and said full bore of said apparatus and a second port adapted to receive a first pressure from said annulus area; and a longitudinally movable mandrel disposed within said outer housing and defining an inside annular space between said outer housing and said mandrel, a second pressure existing within said inside annular space, said first port providing said fluid communication to said full bore of said apparatus when said mandrel is disposed in one longitudinal position within said apparatus, said first port not providing said fluid communication to said full bore when said mandrel is disposed in another longitudinal position within said apparatus, said mandrel moving in one direction between said one longitudinal position and said another longitudinal position within said apparatus when said first pressure received in said second port is greater than said second pressure in said inside annular space by an amount approximately equal to a predetermined value.

2. The apparatus of claim 1, wherein said mandrel moves in another direction opposite to said one direction between said one longitudinal position and said another longitudinal position within said apparatus when said first pressure received in said second port is less than said second pressure in said inside annular space by an amount approximately equal to said predetermined value.

3. The apparatus of claim 2, further comprising:

a piston connected to said mandrel, said piston defining, a first annular space disposed below said piston and located between said outer housing and said mandrel, and said inside annular space disposed above said piston and located between said outer housing and said mandrel.

4. The apparatus of claim 3, further comprising:

a hydraulic circuit disposed within said piston, said hydraulic circuit including, a first passage adapted for moving a medium between said first annular space and said inside annular space, and a second passage adapted for moving said medium between said inside annular space and said first annular space.

5. The apparatus of claim 4, wherein said hydraulic circuit further comprises:

a first one-way check valve in said first passage adapted for moving said medium in a single direction from said first annular space to said inside annular space; and a second one-way check valve in said second passage adapted for moving said medium in a single direction from said inside annular space to said first annular space.

6. The apparatus of claim 5, further comprising:

a chamber for storing said medium, and communicating means responsive to said first pressure from said annulus area received in said second port for fluidly communicating said medium between said chamber and said first annular space.

7. The apparatus of claim 6, wherein said first pressure from said annulus area is received in said second port, said communicating means fluidly communicating said medium from said chamber to said first annular space in response to said first pressure received in said second port, said medium in said first annular space having said first pressure, said first pressure of said medium in said first annular space being exerted against said piston, said piston moving in said one direction when said first pressure of said medium in said first annular space is greater than said second pressure in said inside annular space by an amount approximately equal to said predetermined value, and said mandrel moving in said one direction between said one longitudinal position and said another longitudinal position within said apparatus when said piston moves in said one direction.

8. The apparatus of claim 7, wherein said first port fails to provide said fluid communication between said annulus area and said full bore of said apparatus when said mandrel moves in said one direction between said one longitudinal position and said another longitudinal position within said apparatus, said first one-way check valve in said first passage moves said medium in said one direction from said first annular space to said inside annular space above said piston when said mandrel moves in said one direction, said medium in said inside annular space having said second pressure, said second pressure of said medium in said inside annular space above said piston moving said piston in said another direction opposite to said one direction between said one longitudinal position and said another longitudinal position within said apparatus when said first pressure received in said second port is less than said second pressure in said inside annular space by said amount approximately equal to said predetermined value, and said mandrel moves in said another direction between said one longitudinal position and said another longitudinal position within said apparatus when said piston moves in said another direction.

9. The apparatus of claim 8, wherein said first port provides said fluid communication between said annulus area and said full bore of said apparatus when said mandrel moves in said another direction between said one longitudinal position and said another longitudinal position within said apparatus, said second one-way check valve in said second passage moves said medium in said another direction from said inside annular space to said first annular space below said piston when said mandrel moves in said another direction.

10. A method of operating an valve adapted to be disposed in a wellbore, comprising the steps of:

(a) receiving a pressure in a first port and moving a mandrel of said valve when the pressure received in the first port is greater than a pressure existing in an inside annular space of said valve by an amount approximately equal to a predetermined value;

(b) changing a condition of said valve from a first condition to a second condition when the mandrel is moved in response to the moving step (a);

(c) propagating a medium in a hydraulic circuit from a storage chamber to said inside annular space of said valve when said mandrel is moved in response to the moving step (a) and said condition of said valve is changed to said second condition in response to the changing step (b); and (d) changing said condition of said valve from said second condition to said first condition when said pressure in said inside annular space of said valve is greater than said pressure in said first port by an amount approximately equal to said predetermined value.

11. The method of claim 10, wherein a piston is connected to said mandrel, said piston including said hydraulic circuit, said hydraulic circuit including a first passage fluidly communicable between said storage chamber and said inside annular space and a first one way check valve in said first passage, the propagating step (c) comprising the step of:

(c1) propagating said medium through said first passage of said hydraulic circuit and through said first one way check valve in said first passage from said storage chamber to said inside annular space of said valve when said mandrel is moved in response to the moving step (a) and said condition of said valve is changed to said second condition in response to the changing step (b).

12. The method of claim 11, wherein said hydraulic circuit includes a second passage fluidly communicable between said inside annular space and said storage chamber and a second one way check valve in said second passage, the changing step (d) comprises the step of:

(d1) changing said condition of said valve from said second condition to said first condition when said pressure in said inside annular space of said valve is greater than said pressure in said first port by an amount approximately equal to said predetermined value; and (d2) propagating said medium from said inside annular space through said second passage and through said second one way check valve to said storage chamber when said condition of said valve is changed to said first condition.

13. A valve having a full bore adapted to be disposed in a wellbore, comprising:

an outer housing including a first port fluidly communicating with said full bore and a second port adapted to receive a pressure in said wellbore; and an inner mandrel disposed within the outer housing and defining an inside annular space between said outer housing and said inner mandrel, said inner mandrel adapted to move in a longitudinal direction between one position and another position in response to said pressure received in said second port, said first port being open to said full bore when said inner mandrel moves to said one position, said first port being closed to said full bore when said inner mandrel moves to said another position, said inner mandrel moving in one longitudinal direction when said pressure received in said second port is greater than a pressure in said inside annular space by an amount approximately equal to a predetermined value.

14. The valve of claim 13, wherein said inner mandrel moves in another longitudinal direction opposite said one longitudinal direction when said pressure received in said second port is less than said pressure in said inside annular space by said amount approximately equal to said predetermined value.

15. The valve of claim 14, further comprising:

a piston connected to said inner mandrel thereby defining said inside annular space between said inner mandrel and said outer housing on one side of said piston and a first annular space between said inner mandrel and said outer housing on the other side of said piston.

16. The valve of claim 15, further comprising:

medium storage means for storing a medium therein; and passage means for communicating said medium storage means with said first annular space, said medium in said medium storage means communicating between said medium storage means and said first annular space via said passage means in response to said pressure received in said second port.

17. The valve of claim 16, further comprising:

a hydraulic circuit disposed within said piston adapted for communicating said medium from said passage means between first annular space and said inside annular space.

18. The valve of claim 17, wherein said hydraulic circuit comprises:

a first passage disposed through one side of said piston adapted for communicating said first annular space with said inside annular space; and a first one way check valve disposed in said first passage adapted for flowing said medium in one direction from said first annular space, through said first one way check valve, and to said inside annular space.

19. The valve of claim 18, wherein said hydraulic circuit further comprises:

a second passage disposed through the other side of said piston adapted for communicating said inside annular space with said first annular space; and a second one way check valve disposed in said second passage adapted for flowing said medium in one direction from said inside annular space, through said second one way check valve, and to said first annular space.

20. The valve of claim 19, wherein said pressure in said wellbore is received in said second port, said medium under said pressure disposed in said medium storage means moving to said first annular space via said passage means when said pressure is received in said second port, the pressure of said medium in said first annular space being exerted against said piston, said inner mandrel moving in said one longitudinal direction to said another position when said pressure of said medium in said first annular space is exerted against said piston and said pressure of said medium in said first annular space is greater than a pressure in said inside annular space by said amount approximately equal to said predetermined value.

21. The valve of claim 20, wherein said first port is closed to said full bore when said inner mandrel moves to said another position, said medium in said first annular space moving to said inside annular space via said first passage and said first one way check valve when said inner mandrel moves in the one longitudinal direction to said another position.

22. The valve of claim 21, wherein said inner mandrel moves in said another longitudinal direction to said one position when said pressure received in said second port is less than said pressure in said inside annular space by said amount approximately equal to said predetermined value, said first port being open to said full bore when said inner mandrel moves to said one position, said medium in said inside annular space moving to said first annular space via said second passage and said second one way check valve when said inner mandrel moves in the another longitudinal direction to said one position.

* * * * *